US009349259B1

(12) United States Patent
Denny et al.

(10) Patent No.: US 9,349,259 B1
(45) Date of Patent: May 24, 2016

(54) SELF-LOCKING SHUTTER ASSEMBLY

(71) Applicant: NCR Corporation, Duluth, GA (US)

(72) Inventors: Ian M. Denny, Scotland (GB); Michael Hooks, Loughgall (IE); Rennie McIntosh, Scotland (GB)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 14/815,401

(22) Filed: Jul. 31, 2015

(51) Int. Cl.
*E05F 15/00* (2015.01)
*G07F 19/00* (2006.01)
*E05F 15/603* (2015.01)

(52) U.S. Cl.
CPC ..... *G07F 19/205* (2013.01); *E05F 15/603* (2015.01)

(58) Field of Classification Search
CPC ..... G07F 19/205; G07F 19/20
See application file for complete search history.

(56) References Cited

U.S. PATENT DOCUMENTS 4,251,009 A * 2/1981 McLaughlin ..... G07D 11/0003 109/19
4,949,651 A * 8/1990 Frank ..... G07F 7/005 109/24.1
7,322,528 B2 * 1/2008 Lee ..... G07D 11/0018 235/379
8,459,437 B2 * 6/2013 Guan ..... G07D 11/0018 194/202
8,935,884 B2 * 1/2015 Pang ..... G07D 11/0018 49/324
2003/0111478 A1 * 6/2003 Park ..... G07F 11/10 221/21
2005/0284925 A1 * 12/2005 Ahn ..... G07F 19/205 235/379
2014/0216890 A1 * 8/2014 Liu ..... G07F 19/205 194/351

FOREIGN PATENT DOCUMENTS

WO WO 2010/119451 A2 * 10/2010 ..... G07D 11/00

* cited by examiner

*Primary Examiner* — W B Perkey
(74) *Attorney, Agent, or Firm* — Schwegman, Lundberg & Woessner

(57) ABSTRACT

A device includes a shutter blade supported by an end plate and a cam driver having a cam pin positioned to traverse a slot in the end plate of the shutter blade, the cam pin and slot acting to lock the shutter blade in a closed position, and operating to open the shutter blade as the cam pin traverses the slot.

20 Claims, 7 Drawing Sheets

SELF-LOCKING SHUTTER ASSEMBLY

BACKGROUND

A shutter is used to provide access to a slot in which documents, including cash, may be received and dispensed from in a self-service terminal (SST). When the shutter is in the closed position, it should be difficult to pry open in order to prevent access to the SST in an unauthorized manner. Further, such attempts to pry open shutters can damage the shutter and mechanisms used to move the shutter between the open and closed positions during authorized transactions.

One prior SST utilizes a worm drive and motor positioned near a front of the shutter. The drive and motor are subject to damage during an attack by a vandal attempting to force open the shutter.

SUMMARY

A device includes a shutter blade supported by an end plate and a cam driver having a cam pin positioned to traverse a slot in the end plate of the shutter blade, the cam pin and slot acting to lock the shutter blade in a closed position, and operating to open the shutter blade as the cam pin traverses the slot.

A self-service terminal includes a customer display, a media handling device, a frame adapted to mount below the customer display and through which media items are conveyed, a cam shaft rotatably coupled to the frame having a first and a second cam driver at a respective first and second end of the cam shaft, the cam drivers including a respective first and second driver pin, and a shutter rotatably coupled to the frame via a first end plate having a first cam slot mating with the driver pin of the first cam driver and a second end plate having a second cam slot mating with the driver pin of the second cam driver.

A shutter for a self-service terminal, the shutter includes a shutter blade having a first end and a second end and first and second end plates attached to the respective first and second ends of the shutter blade. Each endplate includes an attachment point providing an axis for rotation of the shutter blade when coupled to a frame such that the shutter rotates about the axis from a closed position to an open position and a cam slot positioned to engage with a drive pin that rotates about a cam shaft axis, the cam slot having an arc formed coaxial with the cam shaft axis such that force applied to the shutter blade to force the shutter blade from the closed to the open position is applied to the drive pin transverse to the cam slot, and a selected movement of the drive pin about the cam shaft axis results in the drive pin traversing the slot and moving the shutter blade to the open position.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

The functions or algorithms described herein may be implemented in software or a combination of software and human implemented procedures in one embodiment. The software may consist of computer executable instructions stored on one or more non-transitory storage devices. Examples of such non-transitory storage devices include computer readable media or computer readable storage devices such as one or more memory or other type of hardware based storage devices, either local or networked and other non-transitory storage devices. The term "module" may be used to represent code stored on a storage device for execution by circuitry, such as one or more processors, which together form specifically programmed circuitry or computer. Modules may also include combinations of code, circuitry, firmware or any combination thereof capable of performing functions associated with the module. Multiple functions may be performed in one or more modules as desired, and the embodiments described are merely examples. The code or software may be executed on a digital signal processor, ASIC, microprocessor, or other type of processor operating on a computer system, such as a personal computer, server or other computer system.

In various embodiments, a self-service terminal (SST) having a display and a cash dispenser utilizes a shutter to control access to cash or other documents provided by the cash dispenser. A frame provides support for the shutter to open and close the shutter. A cam shaft is coupled to the frame has cam drivers at ends of the cam shaft. The cam drivers include driver pins that fit in slots on end plates of the shutter that operate in conjunction with the slots to open and close the shutter when the cam shaft is rotated, and to lock the shutter when in a closed position.

Figure 1:
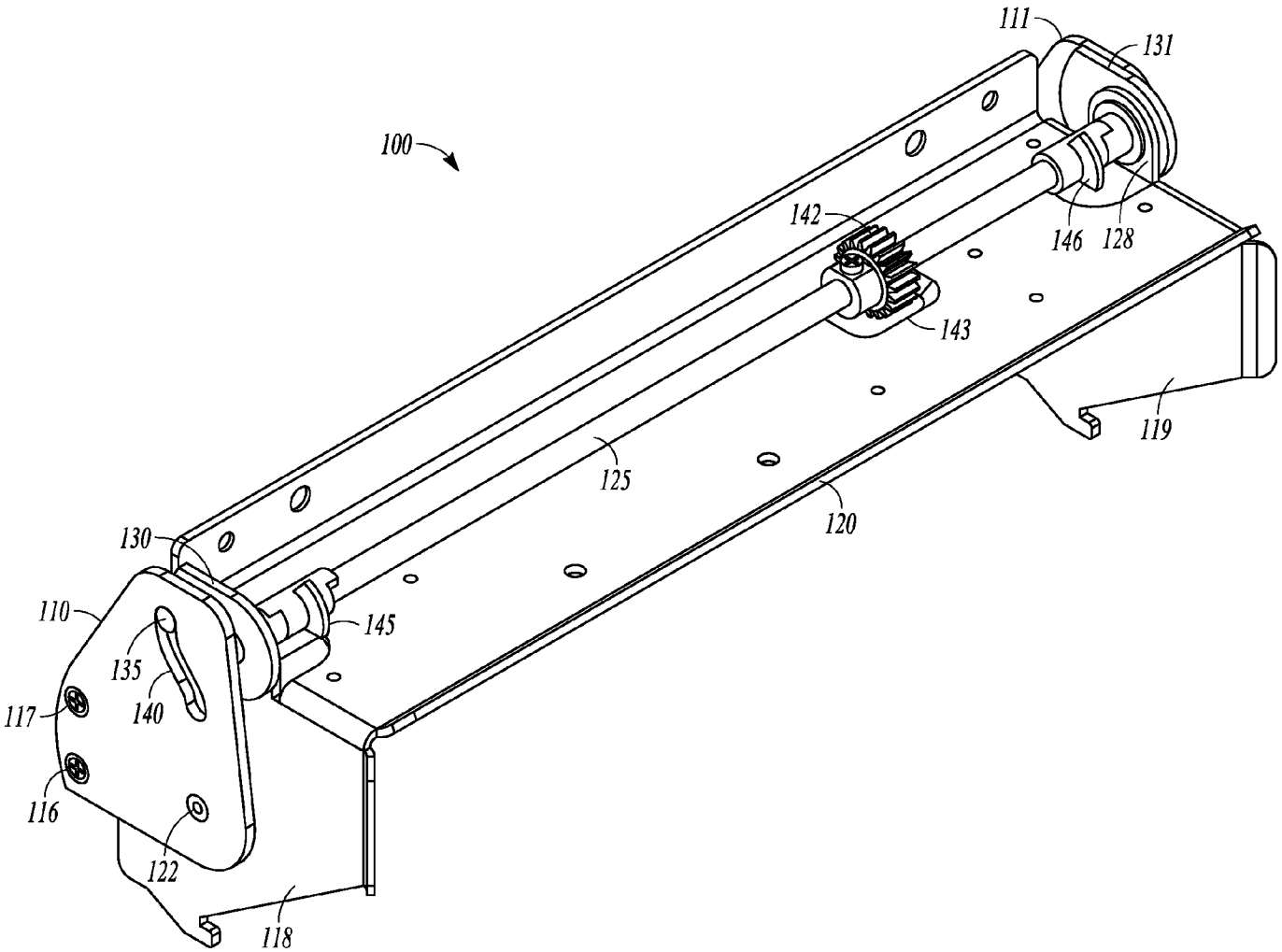
FIG. 1 is a perspective block diagram of a shutter assembly illustrating a cam shaft, drive pin, and shutter end plate slot according to an example embodiment.

FIG. 1 is a perspective block diagram view of a shutter assembly 100. A shutter blade (not shown in FIG. 1) is supported by two end plates 110, 111 coupled to respective ends of the shutter blade such as by screws 116, 117. The end plates are each coupled to ends 118, 119 of a frame 120 at an attachment point 122 about which the end plates and shutter rotate to move the shutter between an open and a closed position. The attachment point 122 may comprise a bolt in one embodiment, or other attachment means to permit rotation of the end plates 110, 111 with respect to the frame at their respective points of attachment. In one embodiment, the attachment point on the end plate is on a side of the end plate that is opposite the shutter to provide a suitable radius of rotation of the shutter.

Frame 120 supports a cam shaft 125 via flanges indicated at 128 (only one shown in FIG. 1) near each end of the frame. Each end of the cam shaft 125 includes a cam driver 130, 131 having a cam pin 135 (only one shown in FIG. 1) positioned to traverse a slot 140 (only one is visible in FIG. 1) in the end plates 110, 111 of the shutter blade. The cam pins 135 are spaced on the cam driver 130, 131 from the cam shaft 125 to rotate about the cam shaft 125. The cam pins 135 and slots 140 act to lock the shutter blade in a closed position, and operate to open the shutter blade as each cam pin 135 traverses a respective slot 140.

A gear 142 with teeth for engaging with teeth of a mating gear of a motor is shown attached to the cam shaft. A recess 143 may be formed in the frame 120 to facilitate rotation of the gear 142 and corresponding rotation of the shaft. One or more flags 145, 146 may also be attached to the cam shaft 125 and may be used in conjunction with optical sensors to sense the rotational position of the cam shaft and corresponding position of the shutter. Such sensed positions may be used to determine a direction of rotation for the cam shaft and when the shutter is fully open or fully closed.

In some embodiments, only one cam pin and slot may be utilized. However, the use of such a combination near each end of the shutter provides a stronger resistance to attempts to pry open the slot by applying upward force to a lower edge of the slot, and further minimize twisting and deformation of the shutter that might result if only one end of the slot is locked.

Figure 2D:
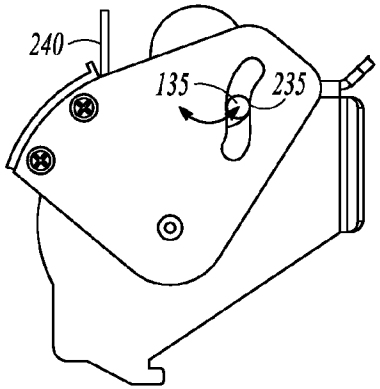
FIGS. 2A, 2B, 2C, and 2D are block side views illustrating opening of a closed shutter according to an example embodiment.
Figure 2C:
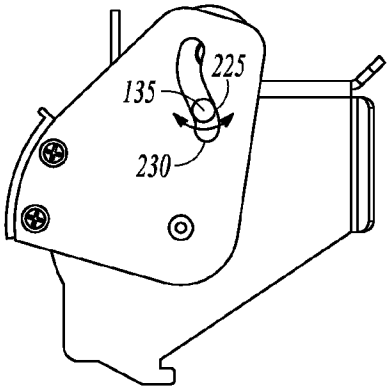
Figure 2B:
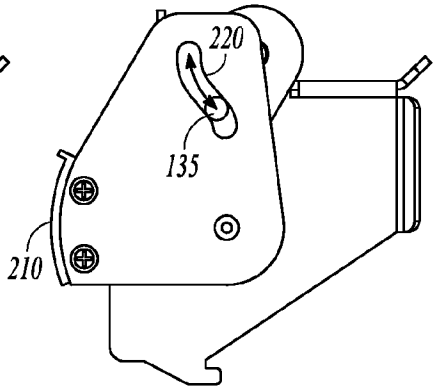
Figure 2A:
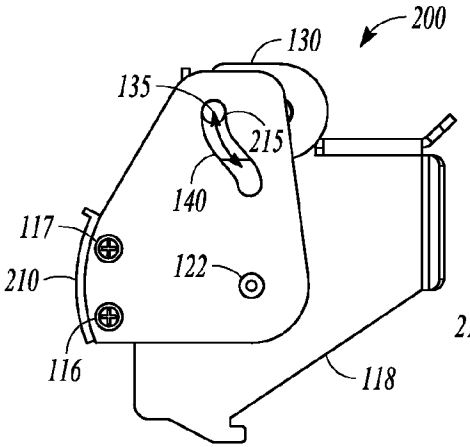

FIGS. 2A, 2B, 2C, and 2D provide side views of the shutter assembly generally at 200, and illustrate opening and closing of the shutter indicated at 210. The reference numbers are consistent with those in FIG. 1. In the progression of figures, the pin 135 may be observed traversing the slot 140. FIG. 2A illustrates the shutter 210 in a closed and locked position. The pin 135 is located in a top or first end 215 of the slot 140. The cam plates 130, 131 are in a rotated position that results in the cam pins 135 being generally toward the shutter 210.

As the cam shaft 125 rotates in a counterclockwise direction in one embodiment, the pin 135, which is coupled to rotate about the cam shaft axis starts to traverse down a first portion 220 of the slot 140. The first portion 220 is curved, forming an arc with a radius of curvature approximately coaxial with the cam shaft 125. This rotation is illustrated in FIG. 2B, where the shutter remains in a closed position.

FIG. 2C illustrates further rotation of the cam shaft 125 causing the pin 135 to continue to traverse the slot 140 in a second portion 225, which curves in a direction somewhat opposite the direction of the curve of the first portion 220 forming an arc having an axis opposite the slots from the cam shaft axis when the shutter blade is in the closed position. The pin 135 reaches or nearly reaches a second or lower end 230 of slot 135 at which point the shutter 210 has begun to rotate towards an open position.

As the rotation of the cam shaft 125 continues, the pin 135 begins to traverse back up the slot 140, moving the shutter to a completely open position when the pin reaches approximately the middle 235 of the slot 140. At this open position, the pin can be seen to have rotated with the cam shaft over 180 degrees, causing the shutter to contact or almost contact a fixed portion of the frame indicated at 240 when the shutter is in a fully open position.

To close the shutter 210, the cam shaft is rotated back to the starting position as indicated in FIG. 2A. During the rotation to close the shutter, the pin 135 applies force to a side of the slot 140 nearest the shutter 210, resulting in rotation of the slot downward towards the closed position. As the pin reaches the top portion 220, the shutter 210 is fully closed and locked in the closed position.

The slot 140 in one embodiment is shown as curved, with the top portion 220 curved in one direction, and the bottom portion 225 curved in an opposite direction. The top 215 of the slot 130 may be positioned level with the cam axis in one embodiment when the shutter 210 is in a closed position. In that closed position, the bottom 230 of the slot 210 may be position above the rotation or attachment point 122 of the end plate. The cam shaft is also located nearly directly above the attachment point 122 of the end plate. This general or initial orientation of the slot and relative positioning of the attachment point 122 and cam shaft 125 facilitates traversal of the pin through a substantial distance of the slot while still retaining the ability to keep the shutter closed, until the rotation of the pin starts to push against the slot after about 90 degrees of rotation, and starts to fully open the shutter 210.

Figure 3:
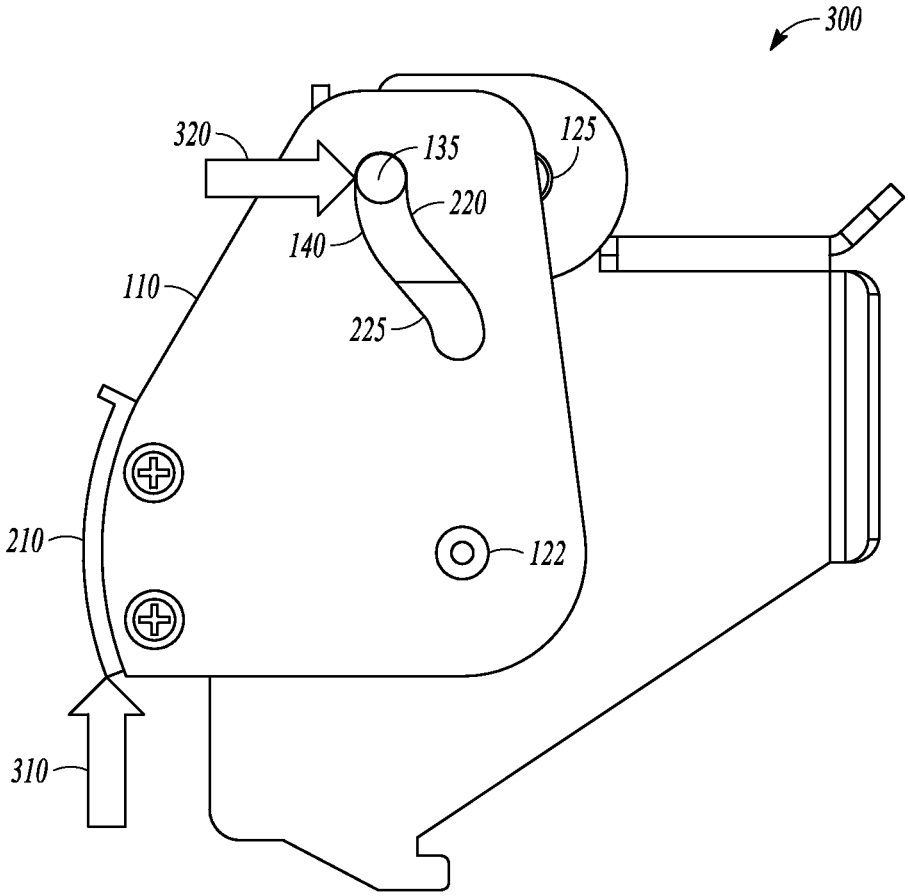
FIG. 3 is a block side view of translated force of a prying force directed at opening a closed shutter according to an example embodiment.

FIG. 3 is a side block view of the shutter assembly indicated at 300 and illustrating forces applied when trying to pry open a closed shutter. When a prying force illustrated by arrow 310 is applied at a bottom of the shutter 210 trying to force it open, that force 310 is translated to force 320 by virtue of force 310 being applied transverse to the axis of rotation indicated at attachment point 122. Thus, force 320 is also a rotational force that is also transverse to the axis of rotation. End plate 110 is thus forced against pin 135 by virtue of slot 140. The force 320 is directly transverse to the axis of rotation of the cam shaft 125. This means that no rotational force is applied to the cam shaft, and no stress is placed on the gear 142 or motor gear.

By orienting the second end of the cam slot directly above the attachment point 122 when the shutter is in a closed position and orienting the first end of the cam slot above the attachment point and toward the shutter, upward force applied to the shutter is applied via the drive pin transverse to the cam slot. As the pin is rotated through the first portion 220 of the slot 140, similar prying force 310 result in force that is still mostly transverse to the cam shaft axis.

As the pin is rotated still further into the second portion, the prying force 310 may result in some force being applied via the pin 135 that is no longer substantially transverse to the cam shaft axis. By this time, the shutter is in the process of being opened anyway, making such prying force superfluous. Note also, that when the shutter is completely open as indicated in FIG. 2D, force to close the shutter is also translated to force applied toward the cam shaft axis. Thus, the shutter is locked in both of the open and closed positions.

The shutter assembly may be used in either left or right hand locations of SSTs without modification. The design of the shutter assembly provides a narrower height profile, allowing compliance with stringent usability height restrictions of various countries, such as the CSA (Canadian Standards Association.) The lower profile may also facilitate the use of a more powerful motor to be packaged into a same space envelope and provide enhanced locking torque characteristics. During a locking phase, the pin can stop over a wide range of positions and still effectively and fully lock the shutter or blade. Still further the shutter may overlap with internal SST cash guides and ensure superior weatherization and attack resistance.

Figure 4:
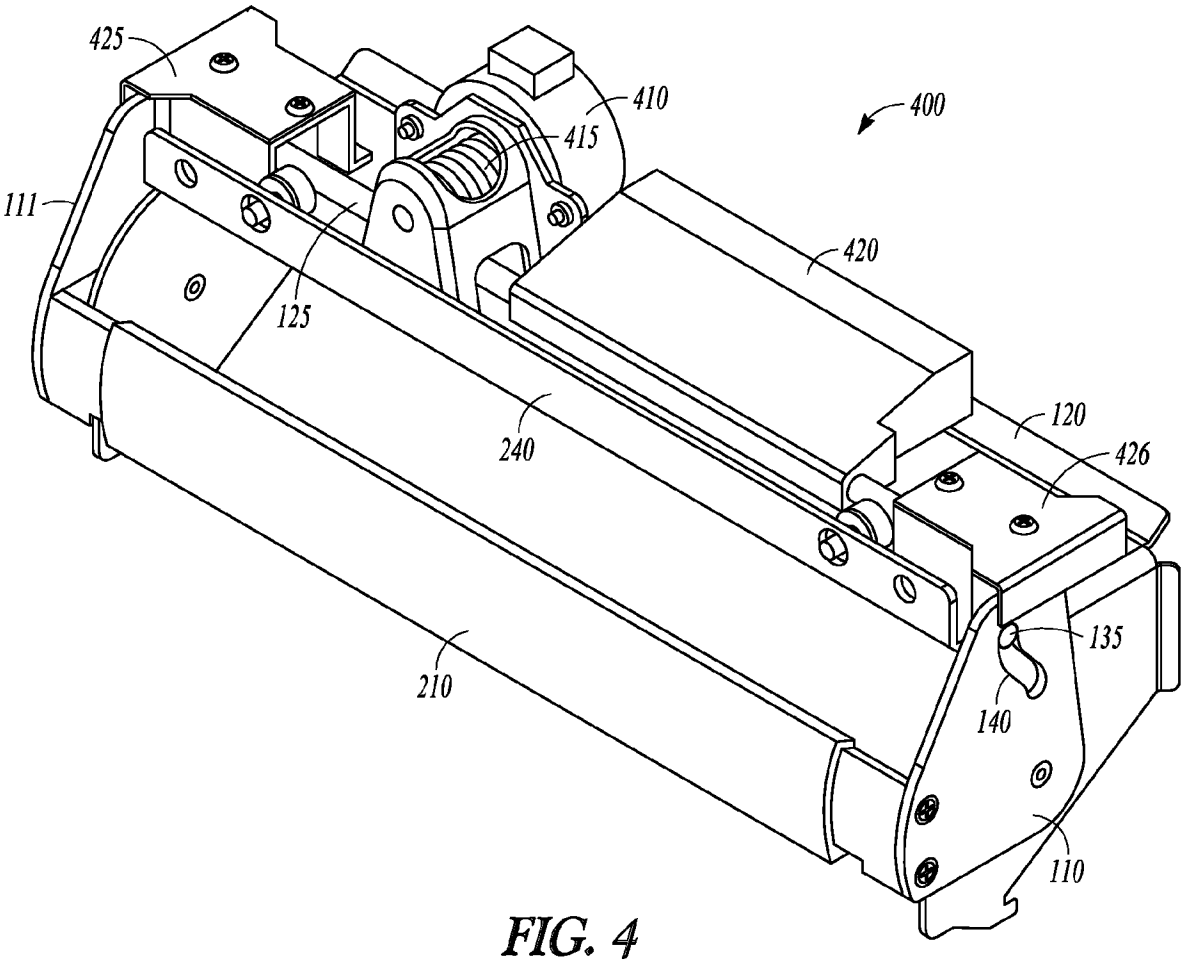
FIG. 4 is a block perspective view of a shutter assembly illustrating the shutter, motor, and sensor housing according to an example embodiment.

FIG. 4 is a perspective view of the shutter assembly indicated generally at 400. The shutter 210 is shown in the closed position. When installed in a self-service terminal (SST), the shutter 210 in conjunction with a fascia of the SST will cover a chamber in which bills may be deposited until the cover opens up into the fascia. A motor 410 is supported by the frame 120 and rotates a motor gear 415 that mates with gear 142 to turn the cam shaft 125. Circuitry 420 may be located proximate the motor 410 to control the motor. The circuitry 420 may also be coupled to the optical sensors to receive signals generated in response to sensing of the positions of the flags 145, 146 and corresponding position of the shutter 210. Sensor housings 425, 426 are shown supported by the frame 120 to support optical sensors in one embodiment such that the flags rotate into a field of view of the sensors mounted in the housings. In some embodiments, circuitry 420 may be included or in communication with a central controller in the SST to receive instructions and provide data to the central controller.

Figure 5:
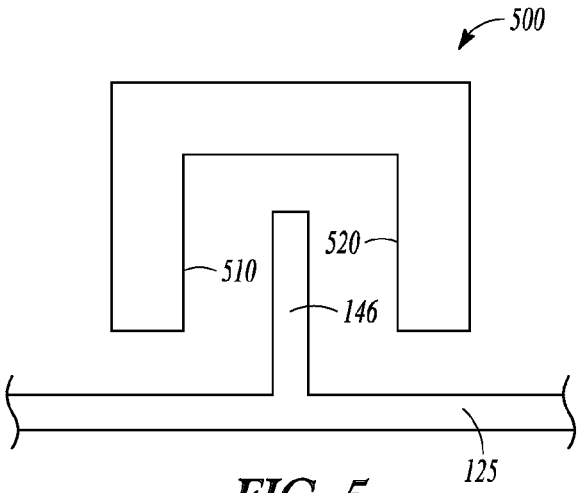
FIG. 5 is a side block view of an optical sensor to detect shutter position according to an example embodiment.

FIG. 5 is a block cross section representation of an optical sensor 500 supported within each of the sensor housing 425, 426. Optical sensor 500 in one embodiment includes a transmitter 500, such as a laser or light emitting diode, spaced from a receiver 520 such as a photo-sensor. The transmitter and receiver are spaced to allow movement of a flag 145 or 146 mounted on cam shaft 125 to move between them depending on rotation of the cam shaft 125. Other types of sensors may be used in further embodiments as a means for detecting an open or closed position of the shutter 210.

Figure 6:
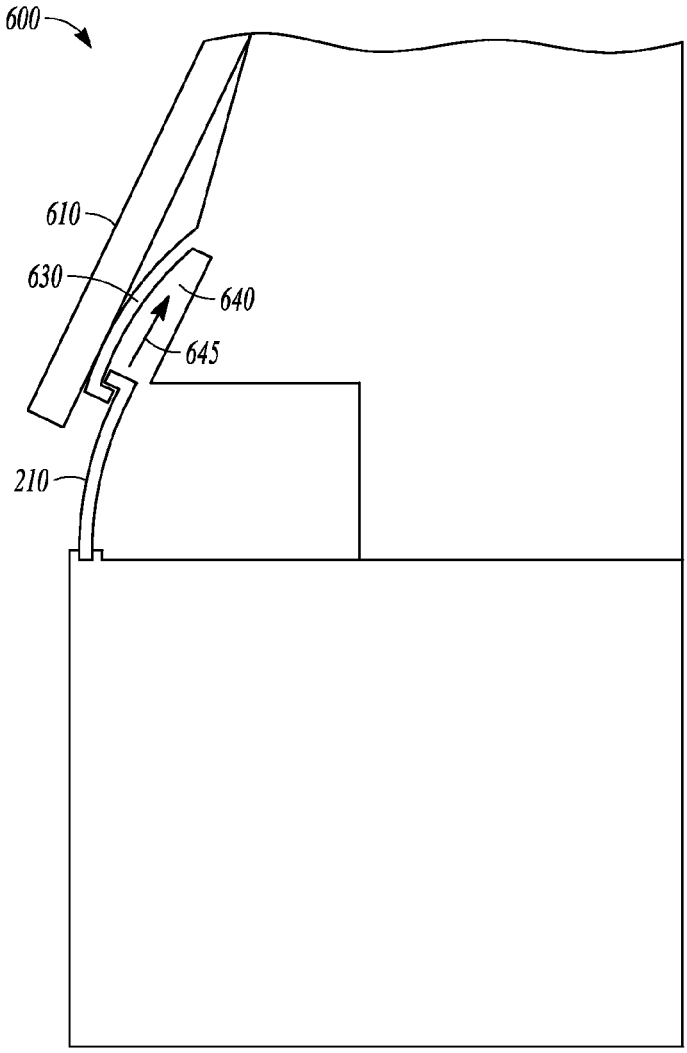
FIG. 6 is a simplified side block diagram of a shutter in a self-service terminal (SST) employing a shutter assembly according to an example embodiment.

FIG. 6 is a block cross section simplified representation of a portion of a self-service terminal (SST) indicated generally at 600. The shutter 210 is shown disposed between a display portion 610 and a dispensing portion 620 of the SST 600. In one embodiment, a front part of the SST 600 includes a fascia 630 that extends from the SST 600 and creates a space 640 for the shutter 210 to move into when the shutter is opened as indicated by arrow 645, exposing materials provided by or to be inserted into the dispensing portion 620. FIG. 6 is not to scale, as the shutter 210 and fascia 630 are shown exaggerated in size to more clearly illustrate the interaction of the shutter 210 with the SST 600. Further, the top of the SST 600 is shown cut off.

Figure 7:
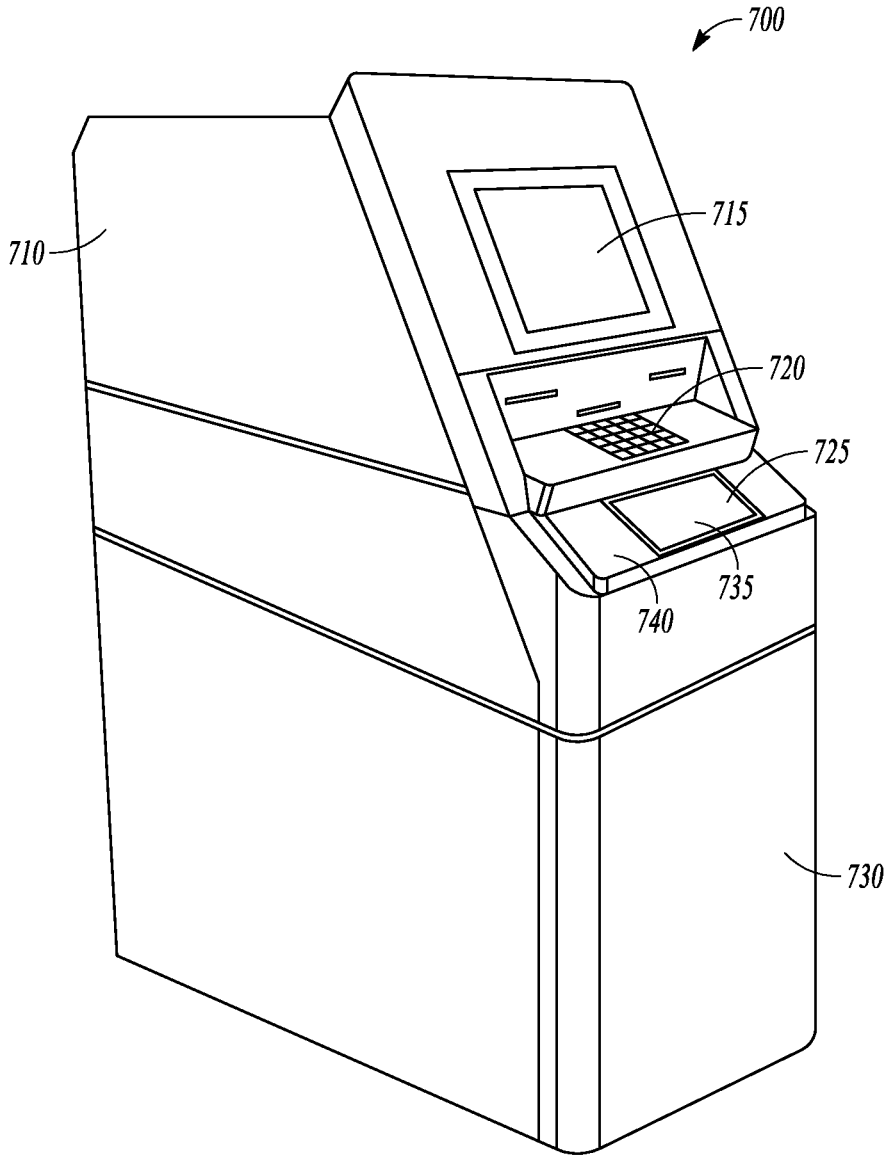
FIG. 7 is a block perspective view of an alternative SST employing a shutter assembly according to an example embodiment.

FIG. 7 is a block diagram view of a further example SST 700. SST 700 may include a chassis 710 that supports multiple modules such as a customer display 715, an encrypting personal identification number (PIN) pad 720, a dispenser 725, a safe or security portion 730, and various other modules that are not shown for clarity of illustration, such as a receipt printer, a statement printer, a depository, a journal printer, a computer core to implement a central controller and control performance of transactions, and other modules in different embodiments.

The dispenser 725 may include a slot having a shutter 735 covering the opening of the slot in a closed position. The slot fits below a fascia 740 of the SST 700. The shutter 735 may fit retractably on the dispenser 725 or the fascia 740 in various embodiments.

In one embodiment, the dispenser 725 may be located within the security enclosure 730, and is operable to receive media items and dispense media items previously received from a customer or provide cash. The slot may be located on the dispenser 725, and the shutter 735 may be located on the recycler or the SST fascia. The shutter 735 may be oriented in differently in various embodiments. While earlier embodiments showed the shutter in a substantially horizontal orientation with the shutter moving up to be in an open position, in further embodiments, the shutter assembly may be rotated to different orientation. The orientation illustrated in FIG. 7 is part way between a vertical and a horizontal orientation.

Figure 8:
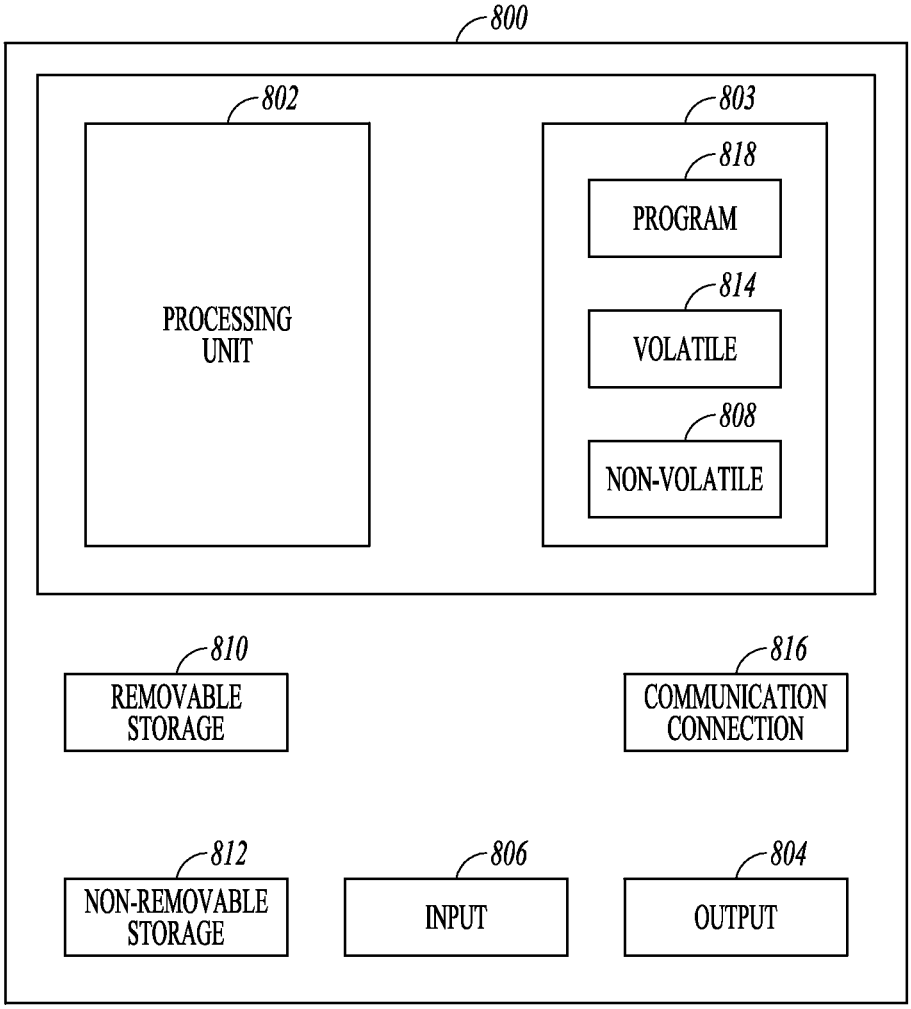
FIG. 8 is a block schematic diagram of a computer system to implement methods and control modules of an SST according to various example embodiments.

FIG. 8 is a block schematic diagram of a computer system 800 to implement methods according to example embodiments, including, but not limited to SST transactions and controlling one or more of the various modules in the SST. All components need not be used in various embodiments. One example computing device in the form of a computer 800, may include a processing unit 802, memory 803, removable storage 810, and non-removable storage 812. Although the example computing device is illustrated and described as computer 800, the computing device may be in different forms in different embodiments. For example, the computing device may instead be a smartphone, a tablet, smartwatch, or other computing device including the same or similar elements as illustrated and described with regard to FIG. 8. Devices such as smartphones, tablets, and smartwatches are generally collectively referred to as mobile devices. Further, although the various data storage elements are illustrated as part of the computer 800, the storage may also or alternatively include cloud-based storage accessible via a network, such as the Internet.

Memory 803 may include volatile memory 814 and non-volatile memory 808. Computer 800 may include—or have access to a computing environment that includes—a variety of computer-readable media, such as volatile memory 814 and non-volatile memory 808, removable storage 810 and non-removable storage 812. Computer storage includes random access memory (RAM), read only memory (ROM), erasable programmable read-only memory (EPROM) & electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage or other magnetic storage devices capable of storing computer-readable instructions for execution to perform functions described herein.

Computer 800 may include or have access to a computing environment that includes input 806, output 804, and a communication connection 816. Output 804 may include a display device, such as a touchscreen, that also may serve as an input device. The input 806 may include one or more of a touchscreen, touchpad, mouse, keyboard, camera, one or more device-specific buttons, one or more sensors integrated within or coupled via wired or wireless data connections to the computer 800, and other input devices. The computer may operate in a networked environment using a communication connection to connect to one or more remote computers, such as database servers, including cloud based servers and storage. The remote computer may include a personal computer (PC), server, router, network PC, a peer device or other common network node, or the like. The communication connection may include a Local Area Network (LAN), a Wide Area Network (WAN), cellular, WiFi, Bluetooth, or other networks.

Computer-readable instructions stored on a computer-readable storage device are executable by the processing unit 802 of the computer 800. A hard drive, CD-ROM, and RAM are some examples of articles including a non-transitory computer-readable medium such as a storage device. The terms computer-readable medium and storage device do not include carrier waves. For example, a computer program 818 capable of providing a generic technique to perform access control check for data access and/or for doing an operation on one of the servers in a component object model (COM) based system may be included on a CD-ROM and loaded from the CD-ROM to a hard drive. The computer-readable instructions allow computer 800 to provide generic access controls in a COM based computer network system having multiple users and servers.

EXAMPLES

In example 1, a device comprises a shutter blade supported by an end plate and a cam driver having a cam pin positioned to traverse a slot in the end plate of the shutter blade, the cam pin and slot acting to lock the shutter blade in a closed position, and operating to open the shutter blade as the cam pin traverses the slot.

In example 2 the device of claim 1 further comprises a frame to mount in a note dispensing portion of a self-service terminal and a cam shaft rotatably coupled to the frame and coupled to the cam driver at an end of the cam shaft.

In example 3, the cam slot of any of examples 1-2 has a curved shape from a first end to a second end such that the driver pin is operable to lock the shutter when positioned proximate the first end.

In example 4, the shutter of example 3 is rotatably attached to the frame at an attachment point on the end plate that is opposite the shutter, and wherein the second end of the cam slot is oriented directly above the attachment point when the shutter is in a closed position, and the first end of the cam slot is oriented above the attachment point and toward the shutter such that upward force applied to the shutter is applied via the drive pin transverse to the cam slot.

In example 5, the curved shape of the slot of example 4 has an axis of curvature centered about the cam shaft for a first portion between the first end and the second end, and curves away from the cam shaft for a second portion between the first end and the second end of the cam slot.

In example 6, the first and second portion of the slot of example 5 are curved to keep the door closed as the drive pin rotates downward in the slot, and to open the shutter as the drive pin continues to rotate beyond the attachment point on the end plate.

In example 7 the pin of example 6 moves from the second end of the slot toward the first end of the slot as the drive pin continues to rotate beyond the attachment point on the end plate.

In example 8, the device of any of examples 1-7 further comprises a frame to mount in a note dispensing portion of a self-service terminal, a cam shaft rotatably coupled to the frame and coupled to the cam driver at an end of the cam shaft, a motor having a motor gear, and a cam shaft gear coaxially coupled to the cam shaft and coupled to rotate the cam shaft responsive to rotation of the motor gear.

In example 9, the device of example 8 further comprises a sensor flag supported by the cam shaft to rotate with the shaft and an optical sensor supported by the frame to detect an open position of the shutter responsive to rotation of the sensor flag.

In example 10, the device of example 9 further comprises a further sensor flag supported by the cam shaft to rotate with the shaft, and a further optical sensor supported by the frame to detect a closed position of the shutter responsive to rotation of the sensor flag.

In example 11, a self-service terminal comprises a customer display, a media handling device, a frame adapted to mount below the customer display and through which media items are conveyed, a cam shaft rotatably coupled to the frame having a first and a second cam driver at a respective first and second end of the cam shaft, the cam drivers including a respective first and second driver pin, and a shutter rotatably coupled to the frame via a first end plate having a first cam slot mating with the driver pin of the first cam driver and a second end plate having a second cam slot mating with the driver pin of the second cam driver.

In example 12, the first and second cam slots of example 11 have a curved shape from a first end to a second end such that the respective first and second driver pins are operable to lock the shutter when positioned proximate the first end of the first and second cam slots.

In example 13, the shutter of example 12 is rotatably attached to the frame at an attachment point on both of the first and second end plates that is opposite the shutter, and wherein the second ends of the first and second cam slots are oriented directly above the attachment point when the shutter is in a closed position, and the first end of the cam slot is oriented above the attachment point and toward the shutter such that upward force applied to the shutter is applied via the drive pin transverse to the cam slot and cam shaft axis to minimize rotational force applied to the cam shaft axis.

In example 14, the curved shape of the first and second cam slots of example 13 have an axis of curvature centered about the cam shafts for a first portion between the first end and the second end, and curves away from the cam shafts for a second portion between the first end and the second end of the first and second cam slots wherein the first and second portion are curved to keep the door closed as the drive pin rotates downward in the slot, and to open the shutter as the drive pin continues to rotate beyond the attachment point on the end plate.

In example 15, any of examples 11-14 further comprise a motor having a motor gear and a cam shaft gear coaxially coupled to the cam shaft and coupled to the motor gear to rotate the cam shaft.

In example 16, any of examples 11-15 further comprises a first sensor flag supported by the cam shaft to rotate with the shaft, a first optical sensor supported by the frame to detect an open position of the shutter responsive to rotation of the first sensor flag, a second sensor flag supported by the cam shaft to rotate with the shaft, and a second optical sensor supported by the frame to detect a closed position of the shutter responsive to rotation of the second sensor flag.

In example 17, a shutter for a self-service terminal comprises a shutter blade having a first end and a second end and first and second end plates attached to the respective first and second ends of the shutter blade. Each endplate comprises an attachment point providing an axis for rotation of the shutter blade when coupled to a frame such that the shutter rotates about the axis from a closed position to an open position and a cam slot positioned to engage with a drive pin that rotates about a cam shaft axis, the cam slot having an arc formed coaxial with the cam shaft axis such that force applied to the shutter blade to force the shutter blade from the closed to the open position is applied to the drive pin transverse to the cam slot, and a selected movement of the drive pin about the cam shaft axis results in the drive pin traversing the slot and moving the shutter blade to the open position.

In example 18, the cam slots of example 17 include a second arc about an axis opposite the slots from the cam shaft axis when the shutter blade is in the closed position.

In example 19 the first arc of example 18 extends from a first end of the cam slot that is substantially on a same horizontal plane with the cam shaft axis and located between the attachment point and the shutter blade, and the second arc extends to a second end of the cam slot that is located generally above the attachment point when the shutter blade is in the closed position.

In example 20, the shutter of any of examples 17-19 has an arcuate shape having an axis of curvature about the attachment point.

Although a few embodiments have been described in detail above, other modifications are possible. For example, the logic flows depicted in the figures do not require the particular order shown, or sequential order, to achieve desirable results.

Other steps may be provided, or steps may be eliminated, from the described flows, and other components may be added to, or removed from, the described systems. Other embodiments may be within the scope of the following claims.

The invention claimed is:

1. A device comprising:

a shutter blade supported by an end plate; and a cam driver having a cam pin positioned to traverse a slot in the end plate of the shutter blade, the cam pin and slot acting to lock the shutter blade in a closed position, and operating to open the shutter blade as the cam pin traverses the slot.

2. The device of claim 1 and further comprising:

a frame to mount in a note dispensing portion of a self-service terminal;

a cam shaft rotatably coupled to the frame and coupled to the cam driver at an end of the cam shaft.

3. The device of claim 1 wherein the cam slot has a curved shape from a first end to a second end such that the driver pin is operable to lock the shutter when positioned proximate the first end.

4. The device of claim 3 wherein the shutter is rotatably attached to the frame at an attachment point on the end plate that is opposite the shutter, and wherein the second end of the cam slot is oriented directly above the attachment point when the shutter is in a closed position, and the first end of the cam slot is oriented above the attachment point and toward the shutter such that upward force applied to the shutter is applied via the drive pin transverse to the cam slot.

5. The device of claim 4 wherein the curved shape of the slot has an axis of curvature centered about the cam shaft for a first portion between the first end and the second end, and curves away from the cam shaft for a second portion between the first end and the second end of the cam slot.

6. The device of claim 5 wherein the first and second portion are curved to keep the door closed as the drive pin rotates downward in the slot, and to open the shutter as the drive pin continues to rotate beyond the attachment point on the end plate.

7. The device of claim 6 wherein the pin moves from the second end of the slot toward the first end of the slot as the drive pin continues to rotate beyond the attachment point on the end plate.

8. The device of claim 1 and further comprising:

a frame to mount in a note dispensing portion of a self-service terminal;

a cam shaft rotatably coupled to the frame and coupled to the cam driver at an end of the cam shaft;

a motor having a motor gear; and a cam shaft gear coaxially coupled to the cam shaft and coupled to rotate the cam shaft responsive to rotation of the motor gear.

9. The device of claim 8 and further comprising:

a sensor flag supported by the cam shaft to rotate with the shaft; and an optical sensor supported by the frame to detect an open position of the shutter responsive to rotation of the sensor flag.

10. The device of claim 9 and further comprising:

a further sensor flag supported by the cam shaft to rotate with the shaft; and a further optical sensor supported by the frame to detect a closed position of the shutter responsive to rotation of the sensor flag.

11. A self-service terminal comprising:

a customer display;

a media handling device;

a frame adapted to mount below the customer display and through which media items are conveyed;

a cam shaft rotatably coupled to the frame having a first and a second cam driver at a respective first and second end of the cam shaft, the cam drivers including a respective first and second driver pin; and a shutter rotatably coupled to the frame via a first end plate having a first cam slot mating with the driver pin of the first cam driver and a second end plate having a second cam slot mating with the driver pin of the second cam driver.

12. The self-service terminal of claim 11 wherein the first and second cam slots have a curved shape from a first end to a second end such that the respective first and second driver pins are operable to lock the shutter when positioned proximate the first end of the first and second cam slots.

13. The self-service terminal of claim 12 wherein the shutter is rotatably attached to the frame at an attachment point on both of the first and second end plates that is opposite the shutter, and wherein the second ends of the first and second cam slots are oriented directly above the attachment point when the shutter is in a closed position, and the first end of the cam slot is oriented above the attachment point and toward the shutter such that upward force applied to the shutter is applied via the drive pin transverse to the cam slot and cam shaft axis to minimize rotational force applied to the cam shaft axis.

14. The self-service terminal of claim 13 wherein the curved shape of the first and second cam slots have an axis of curvature centered about the cam shafts for a first portion between the first end and the second end, and curves away from the cam shafts for a second portion between the first end and the second end of the first and second cam slots wherein the first and second portion are curved to keep the door closed as the drive pin rotates downward in the slot, and to open the shutter as the drive pin continues to rotate beyond the attachment point on the end plate.

15. The self-service terminal of claim 11 and further comprising:

a motor having a motor gear; and a cam shaft gear coaxially coupled to the cam shaft and coupled to the motor gear to rotate the cam shaft.

16. The self-service terminal of claim 11 and further comprising:

a first sensor flag supported by the cam shaft to rotate with the shaft;

a first optical sensor supported by the frame to detect an open position of the shutter responsive to rotation of the first sensor flag;

a second sensor flag supported by the cam shaft to rotate with the shaft; and a second optical sensor supported by the frame to detect a closed position of the shutter responsive to rotation of the second sensor flag.

17. A shutter for a self-service terminal, the shutter comprising:

a shutter blade having a first end and a second end;

first and second end plates attached to the respective first and second ends of the shutter blade, each endplate comprising:

an attachment point providing an axis for rotation of the shutter blade when coupled to a frame such that the shutter rotates about the axis from a closed position to an open position; and a cam slot positioned to engage with a drive pin that rotates about a cam shaft axis, the cam slot having an arc formed coaxial with the cam shaft axis such that force applied to the shutter blade to force the shutter blade from the closed to the open position is applied to the drive pin transverse to the cam slot, and a selected movement of the drive pin about the cam shaft axis results in the drive pin traversing the slot and moving the shutter blade to the open position.

18. The shutter of claim 17 wherein the cam slots include a second arc about an axis opposite the slots from the cam shaft axis when the shutter blade is in the closed position.

19. The shutter of claim 18 wherein the first arc extends from a first end of the cam slot that is substantially on a same horizontal plane with the cam shaft axis and located between the attachment point and the shutter blade, and the second arc extends to a second end of the cam slot that is located generally above the attachment point when the shutter blade is in the closed position.

20. The shutter of claim 17 wherein the shutter has an arcuate shape having an axis of curvature about the attachment point.

* * * * *